US005125653A

United States Patent [19]

Kovács et al.

[11] Patent Number: 5,125,653

[45] Date of Patent: Jun. 30, 1992

[54] COMPUTER CONTROLLER BALL THROWING MACHINE

[76] Inventors: Ferenc Kovács, Vas Gereben u.7, H-1124; László Juhász, Reguly u. 21 H-1089; Attila Szmejkál, Szabolcska M. u. 15, H-1114; Rudolf Liptay, Lumumba u. 151, H-1145, all of Budapest, Hungary

[21] Appl. No.: 603,268

[22] Filed: Oct. 25, 1990

Related U.S. Application Data

[63] Continuation-in-part of Ser. No. 327,807, Feb. 16, 1989, abandoned.

[30] Foreign Application Priority Data

Aug. 11, 1986 [HU] Hungary ..... 3520/86

[51] Int. Cl.[5] ..... F41B 11/00; A63B 69/40

[52] U.S. Cl. ..... 273/29 R; 273/26 D; 124/78

[58] Field of Search ..... 273/26 D, 29 R, 29 A, 273/395; 124/78, 77

[56] References Cited

U.S. PATENT DOCUMENTS

| | | | |
|---|---|---|---|
| 4,442,823 | 4/1984 | Floyd et al. | 124/78 |
| 4,467,424 | 8/1984 | Hedges et al. | 273/138 A |
| 4,501,257 | 2/1985 | Kholin | 273/26 D |
| 4,712,534 | 12/1987 | Nozato | 273/26 D |
| 4,774,928 | 10/1988 | Kholin | 273/26 D |
| 4,915,384 | 4/1990 | Baer | 273/26 D |

FOREIGN PATENT DOCUMENTS

| | | | |
|---|---|---|---|
| 2945588 | 5/1981 | Fed. Rep. of Germany | 124/78 |
| 3407972 | 10/1985 | Fed. Rep. of Germany | 273/26 D |
| 2568134 | 1/1986 | France | 273/26 D |
| 8500530 | 2/1985 | World Int. Prop. O. | 273/26 D |

*Primary Examiner*—Edward M. Coven
*Assistant Examiner*—Jessica J. Harrison
*Attorney, Agent, or Firm*—Handal & Morofsky

[57] ABSTRACT

A new ball throwing machine for ejecting tennis balls comprising an adjustable ball throwing mechanism, a microcomputer controlling the throwing mechanism for programmed stroke sequences, and a remote control unit attached to the microcomputer and having a touch pad keyboard for direct assignment of impact points of the balls and for command selection and, for balls impacting on a center line of a tennis court, the throwing mechanism is controlled for determining a vertical angle and a launching speed of throwing out the balls on basis of linear interpolation between co-ordinates of two check points of the impact of balls, of a training level and a stroke type preselected on the keyboard, and the first check point is a meshing point of a net and the center line of the tennis court, the second check point is a meshing point of a baseline and the center line; for all other balls, also a horizontal angle of throwing out the balls is determined by a simple trigonometric relation, and a memory is provided in the microcomputer for storing the angle and speed data of each impact point.

8 Claims, 6 Drawing Sheets

COMPUTER CONTROLLER BALL THROWING MACHINE

CROSS-REFERENCE TO RELATED APPLICATIONS

This application is a continuation-in-part of copending U.S. patent application Ser. No. 327,807 of Ferenc Kovacs, et al, filed Feb. 16, 1989, and entitled "COMPUTER CONTROLLED BALL THROWING MACHINE", abandoned.

BACKGROUND OF THE INVENTION

The invention relates to a ball throwing machine for ejecting tennis balls comprising an adjustable ball throwing mechanism, a microcomputer controlling the throwing mechanism for programmed stroke sequences, and a remote control unit attached to the microcomputer and having a touchpad keyboard for direct assignment of impact points of the balls and for command selection.

The tennis ball throwing machines gain more and more in importance as the level of the tennis play gets higher and the stroking techniques get more and more sophisticated. If a skilled player is to be trained in returning high speed balls, spinning or sliced balls or even lobs for a long time and precisely with the same impact point, then a highly qualified training partner is needed who is able to satisfy these requirements. In the computer age, this partner can be substituted by a sophisticated electronic ball throwing machine being able to eject balls of all stroke types with sufficient speed and accuracy.

In the known throwing machines, the stroke direction is to be adjusted by hand as, for example, with the pneumatic ball throwing machines. Therein, the ball moves forward in a narrow tube due to the high air pressure behind it and leaves the tube with a speed corresponding to the air pressure. The spinning or slicing of the ball can not be realized with this type of machines and, because of the continuous air compression, the operation is very noisy.

The advanced throwing machines apply a mechanical launching system having two rotating wheels which are driven in opposite directions. At the periphery of the wheel, special rubber coating corresponding to the ball shape are provided. The ball speed depends on the rotation frequency of the wheels. In some types of these electromechanical machines, the launching angle is adjusted sidewards in the horizontal plane using a motor driven mechanism. However, the adjustment in the vertical plane can be carried out only by tilting the whole ejecting mechanism by hand.

In some conventional machines, the angle of the launching can be varied in both planes, i.e. in horizontal and vertical directions, too, using motor driven mechanisms with electronic control. However, the electronic system used for the control allows only a very limited number of programmed strokes in a sequence, restricted to the most popular stroke sequences only, as the strokes to right-left, right-middle-left, base-line-drop-shot, or some simple combinations of them.

The more up-to-date known machines are able to play longer stroke sequences, too, however, the number of the programmed strokes remains under 32 and the programming itself is very time consuming. In addition, they are not adapted for correcting the ball flight by programming and for controlling automatically the ball wear-out.

Another insufficiency of the known machines is the lack of remote control, which would allow for the player to program the game from his own place on the court. In fact, the remote control of the known machines is limited to the on/off switch of the main supply or to some very simple command as start the play, turn to the continuous play or stop. None of them, however, has an easy-to-use, battery-fed hand-held remote control unit for program data entering.

SUMMARY OF THE INVENTION

The main object of the invention is to eliminate the drawbacks of the known solutions and to provide an easy-to-use ball throwing machine for ejecting tennis balls with which the real tennis game can be simulated.

According to the improvement in this invention, for balls impacting on a center line of a tennis court, the throwing mechanism is controlled for determining a vertical angle and a launching speed of throwing out the balls on basis of linear interpolation between coordinates of two check points of the impact of balls, of a training level and a stroke type preselected on the keyboard, and the first check point is a meshing point of a net and the center line, the second check point is a meshing point of a base line and the center line; for all other balls, also a horizontal angle of throwing out the balls is determined by a simple trigonometric relation, and a memory is provided in the microcomputer for storing the angle and speed data of each impact point.

In a preferred embodiment of this invention, cursor-like correction keys are provided on the keyboard for correcting the angle and speed data of the impact points, and a non-volatile type memory in form of a look-up table is provided for storing the corrected angle and speed data of the check points.

It is also preferred in another embodiment, that a strain gauge is provided in the throwing mechanism and connected to the microcomputer for correcting the angle and speed data of the impact points in dependence of ball qualities measured by the strain gauge.

It can also be preferred, when the non-volatile type memory in form of a look-up table stores the angle and speed data for ten different training levels and four different stroke types for the check points.

In still another preferred embodiment in this invention, the remote control unit is attached to the microcomputer by a wireless connection.

Further objects and details will be described hereinafter on the basis of preferred embodiments with reference to the attached drawings.

DETAILED DESCRIPTION OF PREFERRED EMBODIMENTS

Figure 1:
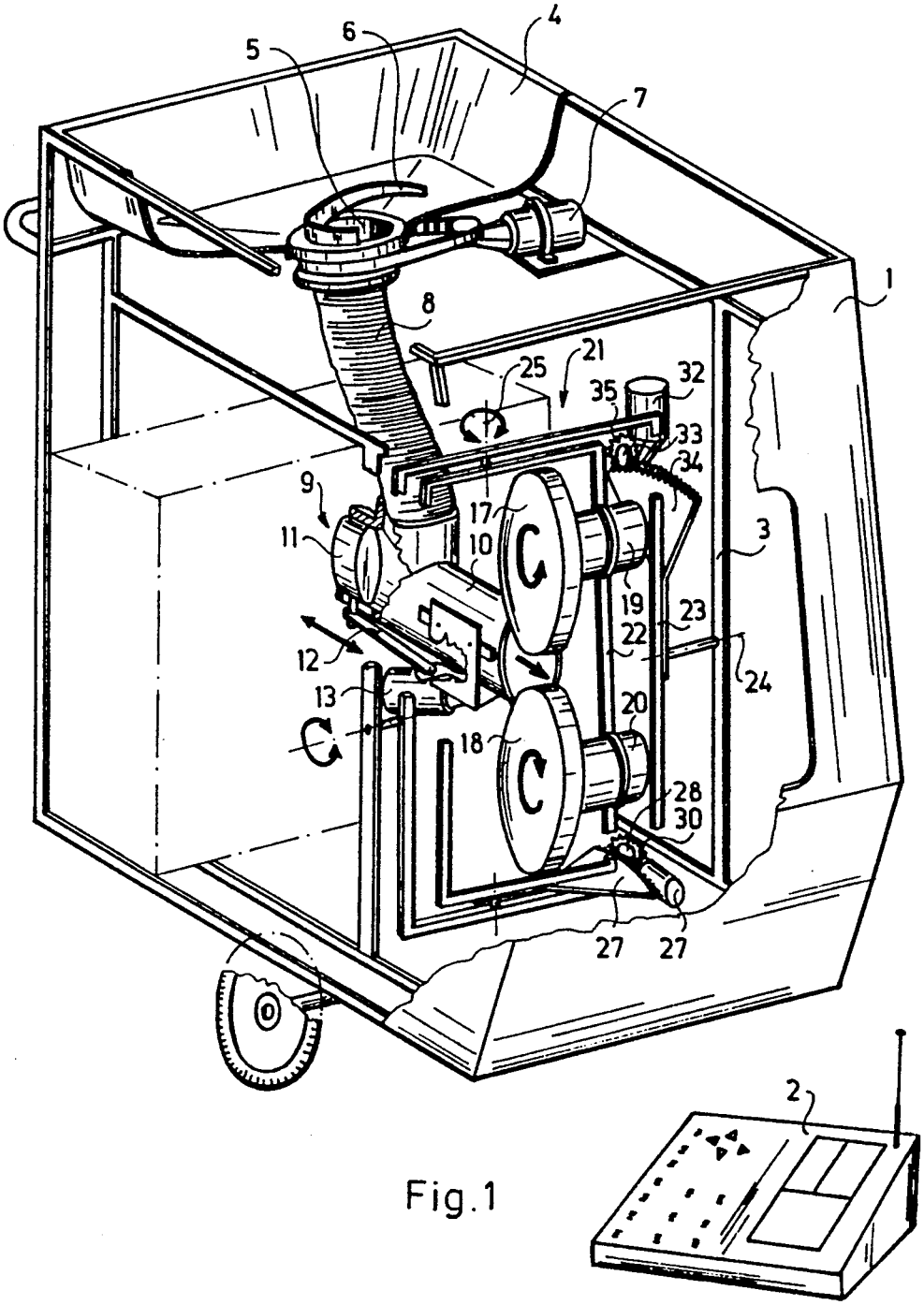
FIG. 1 is a perspective view of a preferred embodiment of the ball throwing machine in this invention.

As is shown on the perspective view of a preferred embodiment of the ball throwing machine in this invention (FIG. 1), the main parts of it are a central unit 1 for containing and launching the balls, and a remote control unit 2 for data entering and data display.

The housing of central unit 1 has an inner framework 3 and an upper ball container 4 with an outlet 5 around which a rotating stub 6 driving the balls through outlet 5 into a pipe 8 is arranged. Stub 6 is rotatably driven by a motor 7.

Figure 2:
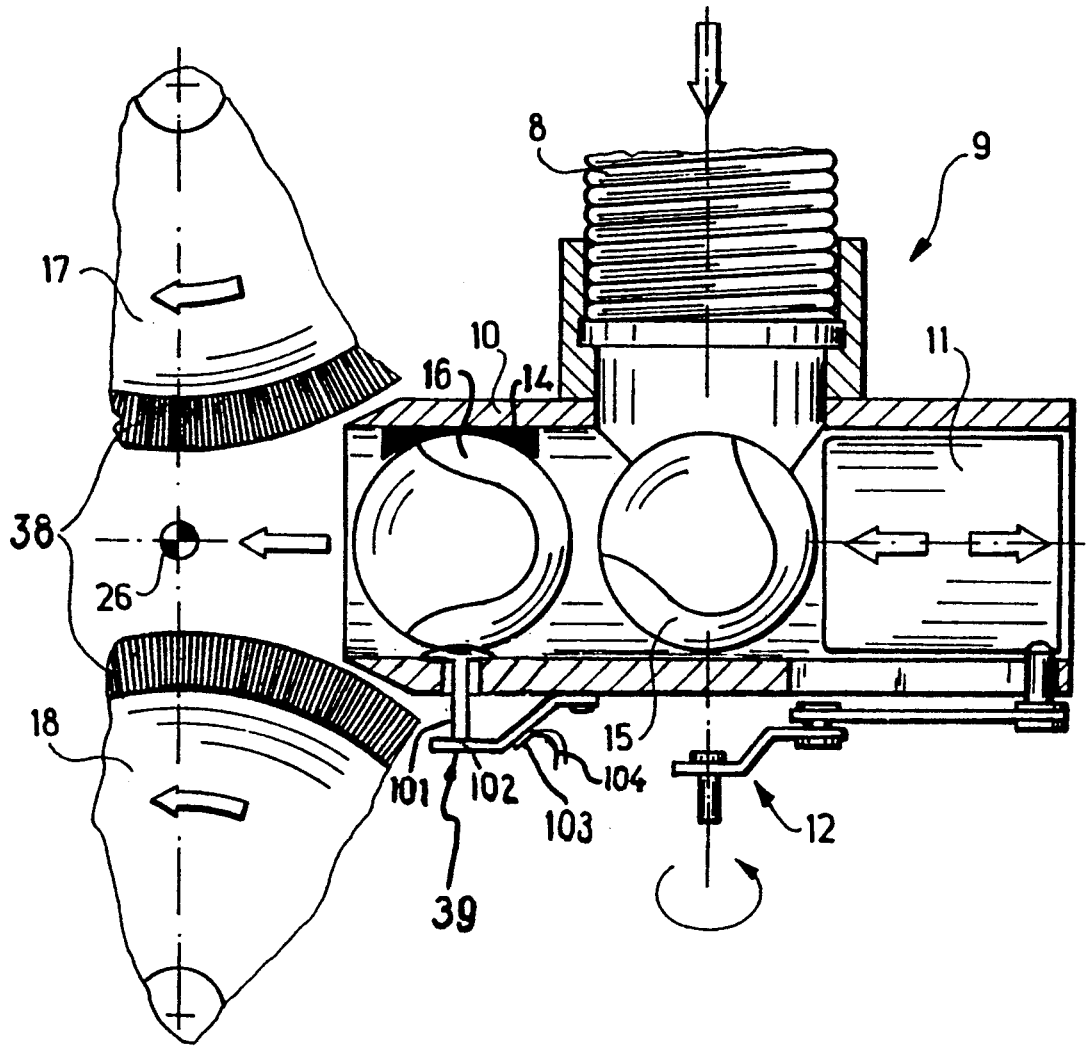
FIG. 2 shows a detail of the embodiment in FIG. 1: the side elevational view of the ball feeder.

In the inside of central unit 1, a ball feeder 9 is attached to pipe 8, which is also shown in more detail in FIG. 2. Flexible piep 8 made of a spring, guides a ball from container 4 to a barrell 10. In barrel 10, a piston 11 is slideably arranged and driven by an excentric mechanism 12 driven by a motor 13. A ball fallen out from pipe 8 before piston 11 will be pushed towards ejecting wheels 17 and 18 each having on its periphery a special rubber coating 38. A ball 15 (FIG. 2) fallen out from pipe 8 will push thereby a previous ball 16 in between ejecting wheels 17 and 18. Wheels 17 and 18 are driven by separate motors 19 and 20.

As is shown in FIG. 2, for more reliabile operation, barrel 10 has at its outlet a ball catching grip 14 and a strain measuring apparatus 39 arranged on it. Force transmitting stub 101 bends flexible holding plate 102 when ball 16 is in grip 14. Strain gauge 103 measures the effect of stub 101, responding to ball 16, on plate 102. With this, the hardness, elasticity, wear-out and other physical parameters of balls 15, 16 are observed and delivered to the microcomputer via wiring 104 of the throwing machine, The launching of the ball 16 will occur out from a geometrical middle point 26 in which the vertical and the horizontal axes of the movable launching mechanism intersect.

Figure 3:
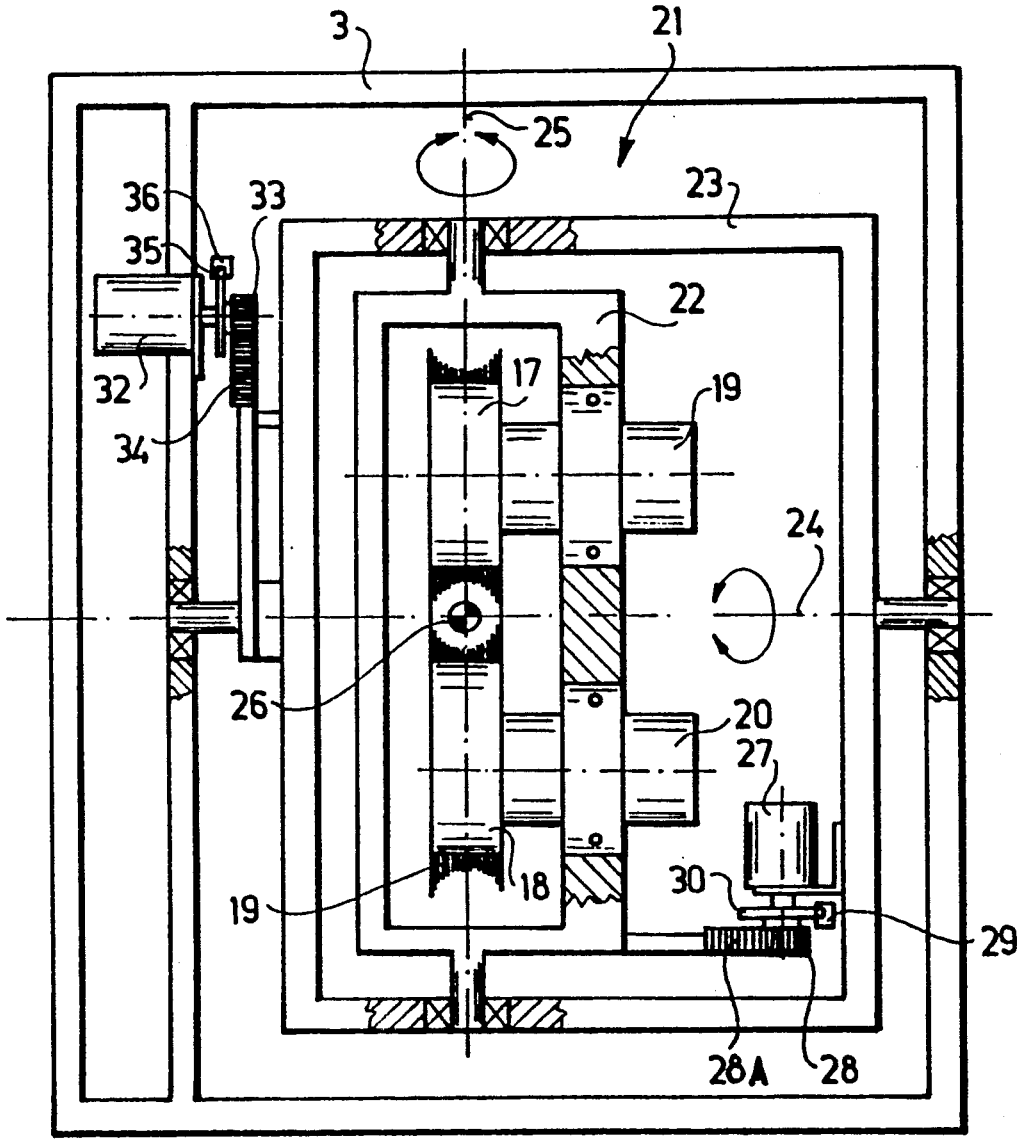
FIG. 3 shows a further detail: the front view of the ball throwing mechanism.

In FIG. 3, a launching or ball throwing mechanism 21 is shown in more detail. Essentially, it has two rotatably driven frames 22 and 23. Outer frame 23 is attached by an axle 24 of rotation to housing 3 and inner frame 22 is attached by an axle 25 of rotation to inner frame 23. At the intersection of axles 24 and 25 is a middle point 26, out of which ball 16 will be thrown out. Furthermore, inner frame 22 holds feeding barrel 10 with piston 11 as well as driving motors 19 and 20 of the two juxtaposed, oppositely rotating wheels 17 and 18.

Inner frame 22 is moved by a right/left adjusting motor 27 mounted on outer frame 23 and having a toothed wheel 28, which drives a toothed arcuate member 28A fixed to inner frame 22. On the axis of motor 27, a code disc 30 is also fixed which co-operates with an optical sensor 29 observing the right/left turning of toothed wheel 28. With this, signals will be delivered about the angle position of the inner frame 22 to the microcomputer.

Outer frame 23 is rotatably driven by an up/down adjusting motor 32 fixed to housing 3. The rotation is transmitted, in this case, too, by a toothed wheel 33 fixed to the axle of motor 32 and a toothed arcuate member 34 fixed to outer frame 23. A code disc 35 fixed to the axle of motor 32 and a sensor 36 co-operating with code disc 35 and observing the up/down turning of toothed wheel 33 are also provided.

All moving mechanical parts are electronically controlled by the microcomputer.

The launching parameters consist of the vertical and the horizontal angle of the launch and of the launching speed of the ball determined by the frequency of the two ejecting wheels 17 and 18. The launching parameters vary according to the impact point locations, the training level and the stroke type.

According to this invention, the launching parameters of the balls thrown out of central unit 1 are generated by calculation. This launching parameters are for balls to be impacted on a longitudinal centerline of the tennis yard the vertical angle of launch and the launching speed as well as the chosen training level and stroke type, and for other balls, auxiliarily to the above data, a horizontal angle of launch.

The calculation is based on linear interpolation between the co-ordinates of two check points of the tennis yard for the vertical angle and the launching speed. The idea is suggested by the fact, that the launching parameters vary nearly linearly along the center line, furthermore that the flight curve of the balls directed to the side doesn't differ significantly from the curve of balls impacting on the center line. The center line is, as mentioned above, a connecting line between the middle of the baseline and the middle of the net. Check points are the two and points of the centre line, i.e. the meshing points of centre line and the net and the base line.

Based on this, it has to be stored only the launching parameters of the check points. The parameters of impact points along the center line can be calculated from the parameters of the check points and from the distance of the location from the baseline, by simple mathematical relation of the linear interpolation.

For impact points outside the center line, the launching parameters are the same as for the points on the center line, except the horizontal angle of launch, which can be calculated by a trigonometric relation, putting in the distance of the location from the center line.

Therefore, for a given training level and for a given stroke type, only the launching parameters of the two check points should be stored. These groups of parameters, called as a set, will be used hereupon as a look-up table, i.e., the calculation related to all other locations will be based on the data stored in the lock-ep table. Regarding the ten different values of the training level and the four different stroke types, the look-up table will contain fourty sets of parameters. However, it should be noted, that because of the different rotational speeds of upper and lower ejecting wheels 17, 18 in the case of spinned or sliced strokes, the number of the stored wheel frequencies will be four in these sets.

The calculations mentioned above allow to make corrections of the impact point drift due to the ball qualities such as elasticity, wear-out etc., by reloading the look-up table with corrected launching parameters. The look-up table is in fact a non-volatile type memory, thus, the look-up table preserves these adjusted values even if the main supply is cut off.

For a better simulation of all types of strokes, a more accurate method of calculation, the parabolic interpolation can also be used. In this case, besides the two parameters a third constant is applied which should be characteristic to the shape of the mathematical function of the parameter along the center line. In the marginal case, referring to the linearity of the parameter, the value of the constant will be zero.

When using different types of balls or balls with significantly different wear-out within the lot, the spread of the impact points may be disturbing. This can be avoided by the built-in strain measuring apparatus 39 mounted on ball catching grip 14. The output electric signal of this is led to the microcomputer by wiring 104 which derives a compensation factor of it for high accuracy calculations of the flight curve and stroke parameters. The relation between the strain-gauge output voltage, depending on the size and the elasticity of the ball, and the value of the compensation factor will be determined experimentally.

Figure 4:
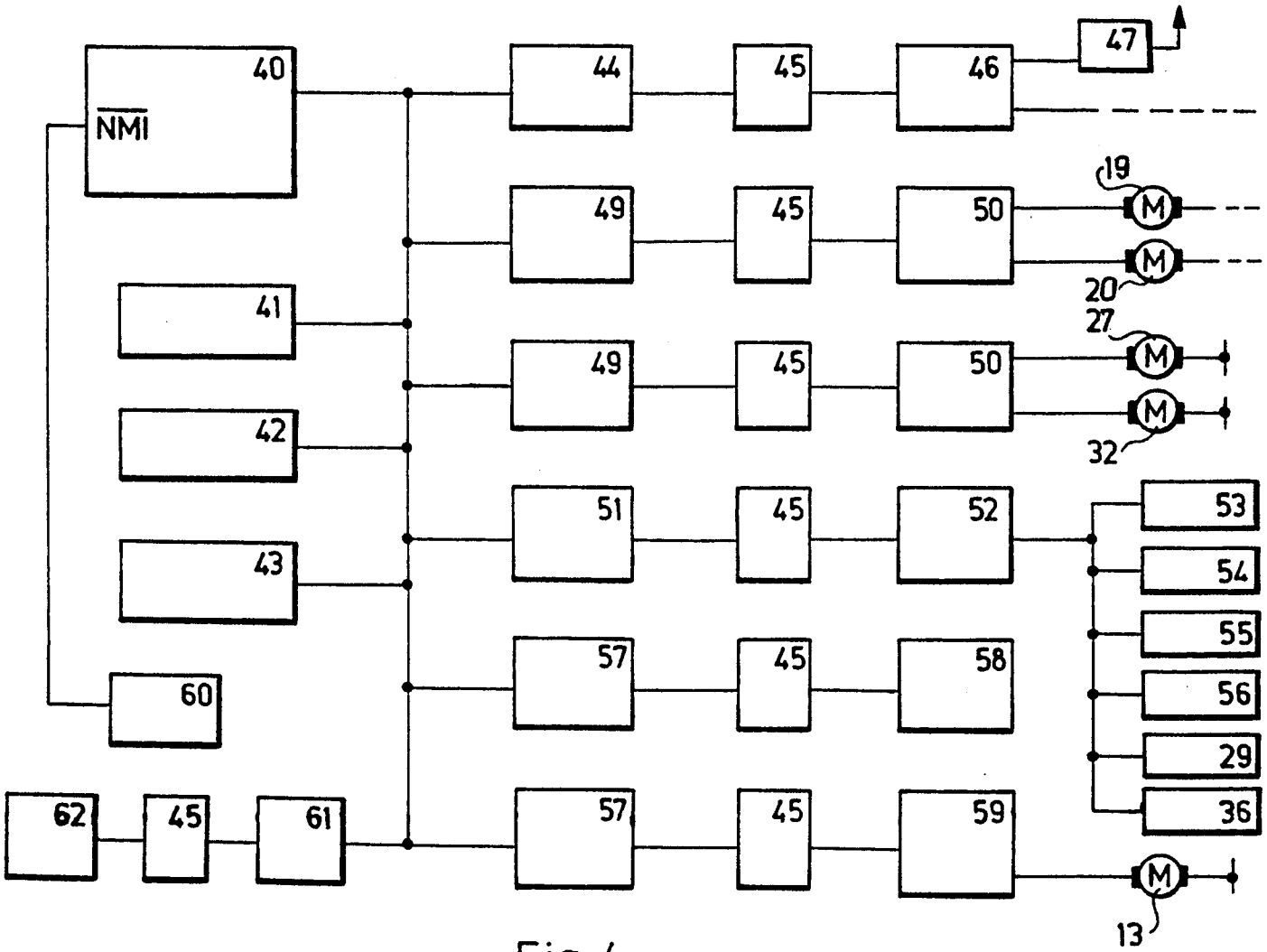
FIG. 4 is still another detail: a block diagramm of a preferred embodiment of the programmed control unit.

A block diagram of the calculation of the launching paramaters is shown in FIG. 4. The main part of the machine is a microprocessor 40 with which the very high requirements in connection with the complicated real-time control of the moving parts and with the necessary arithmetic operations can be satisfied. For the given purpose, a low-cost eight bit microprocessor 40 with a clock frequency of 2 MHz is used. A static read/-write memory 41 with 2 Kbyte capacity, an electrically programmable read-only memory 42 with a storage capacity of 16 Kbyte and an electrically erasable/programmable read-only memory 43 for non-volatile program/data storage with a capacity of 128 byte are connected to the address and data buses of microprocessor 40.

To realize a data transfer to and from remote control unit 2, a two-channel input/output interface 44 is applied, which communicates through an optocoupler 45 with an interface 46. Interface 46 includes circuits for driving and receiving the two-wire data link to remote control unit 2 and, in addition, a transmitter/receiver circuit 47 for the radiofrequency link in the case of the wireless remote control.

In order to control driving motors 19, 20 of ejecting wheels 17 and 18, a four-channel counter/timer circuit 49 is used for timing the thyristor ignition pulses to the zero crossover of the main supply frequency. The counter/timer 49 controls a dual flow-angle regulated thyristor power circuit 50 for motors 21 and 22, through optocoupler 45.

Another four-channel counter/timer circuit 49 serves for controlling the two position adjusting motors 27, 32 by regulating the level and the polarity of the voltages. The turning-on pulses by proper timing control dual power circuit 50 through optocoupler 45 for driving up/down adjusting motor 32 and right/left adjusting motor 27, in order to achieve the wanted angle of the ejecting.

An eight-channel parallel input circuit 51 with its interrupt capability serves for receiving the input signals of sensors 29, 36 mounted on the moving parts of the launching mechanism. Input circuit 51 receives the signals of upper wheel 17 sensor 53, lower wheel 18 turning sensor 54, up/down center position sensor 55, right/left center position sensor 56, up/down turning sensor 36 and right/left turning sensor 29, through an interface 52 and optocoupler 45.

An output interface circuit 57 is applied in order to give light or sound signals for start indication of the following stroke with a signalling circuit 58 and optocoupler 45.

A similar output interface 57 connected to the microprocessor data bus serves for driving ball pushing motor 13 in order to push the ball between the two rotating wheels 17, 18. A regulated power supply 59 will be turned-on through optocoupler 45.

A trigger circuit 60 with its long hold time connected to the non-maskable interrupt input of microprocessor 40 serves to periodiclly interrupt request and calling hereby a built-in self-check routine in order to test the error free operation of the system and avoid any not allowed program jumping due to occasional high electric field disturbances.

An optical three-channel parallel input/output circuit 61 gives the possibility of a link through optocoupler 45 to a host computer 62 for software development or hardware test, or to connect more throwing machines to one another.

Figure 5:
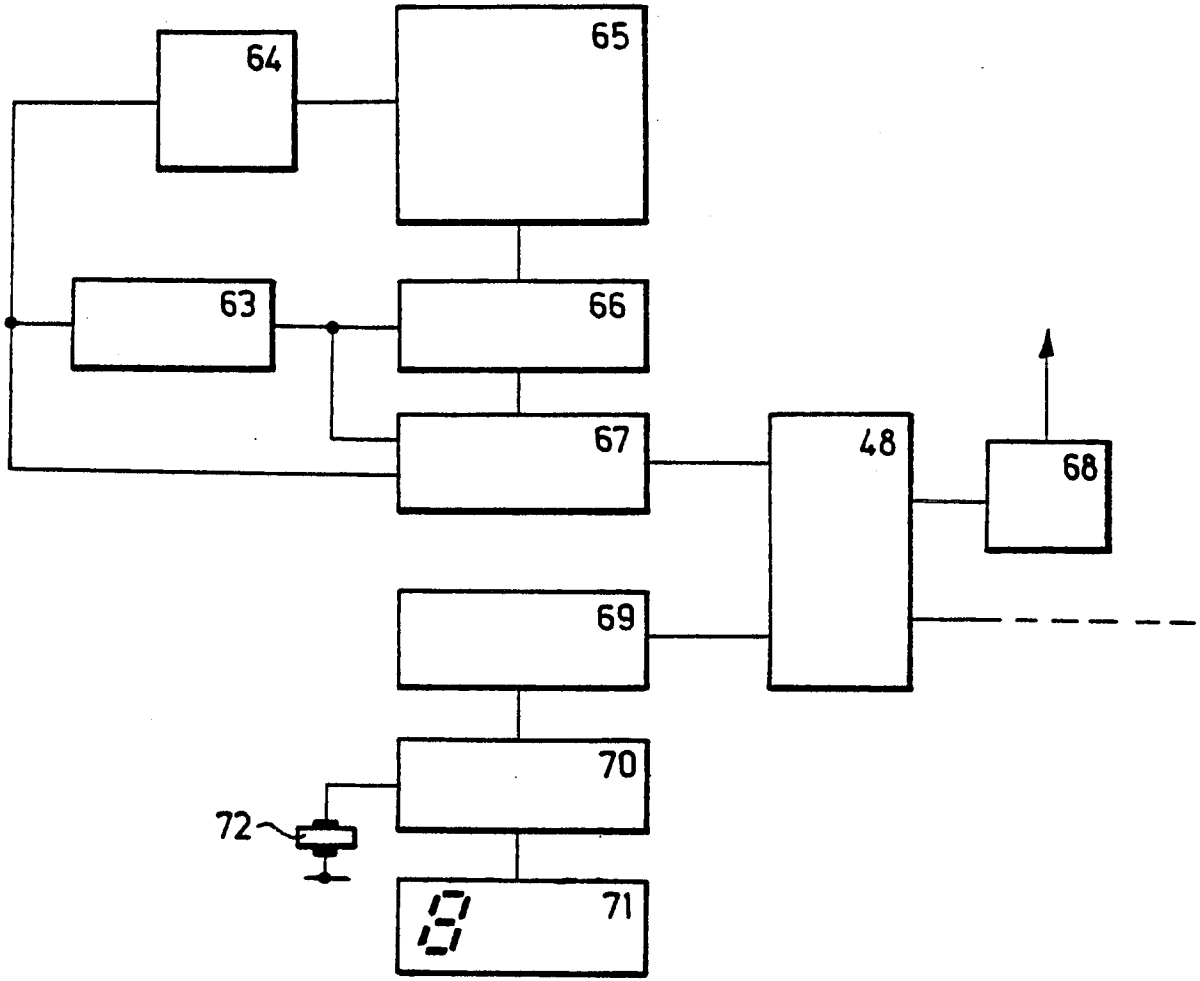
FIG. 5 shows another detail: a block diagramm of a preferred embodiment of the remote control unit.

The block diagram of the battery fed remote control unit 2 is shown in FIG. 5. A counter 63 activates the rows and columns of 16×16 key matrix 65. A row decoder 64 selects the logical high state for the rows. Counter 63, on the other hand, controls the select inputs of a column multiplexer 66.

The actual value of counter 63 will be loaded into a register 67 whenever one of the keys is pressed. The output data is led to an input/output interface circuit 48 to drive the interface 46 of microcomputer 40 through a cable. A transmitter/receiver circuit 68 is used if radiofrequency link is applied for remote control.

A liquid crystal display 71 serves to inform the player or the coach about the mode of operation, the selected training level and the selected stroke type. The data for the display coming from interface 48 is stored by a shift register 69 and will be converted by a decoder/driver 70. A buzzer circuit 72 gives sound signal when a valid data was supplied into microcomputer 40, but also indicates all valid presses on the keyboard by a warning signal.

Figure 6:
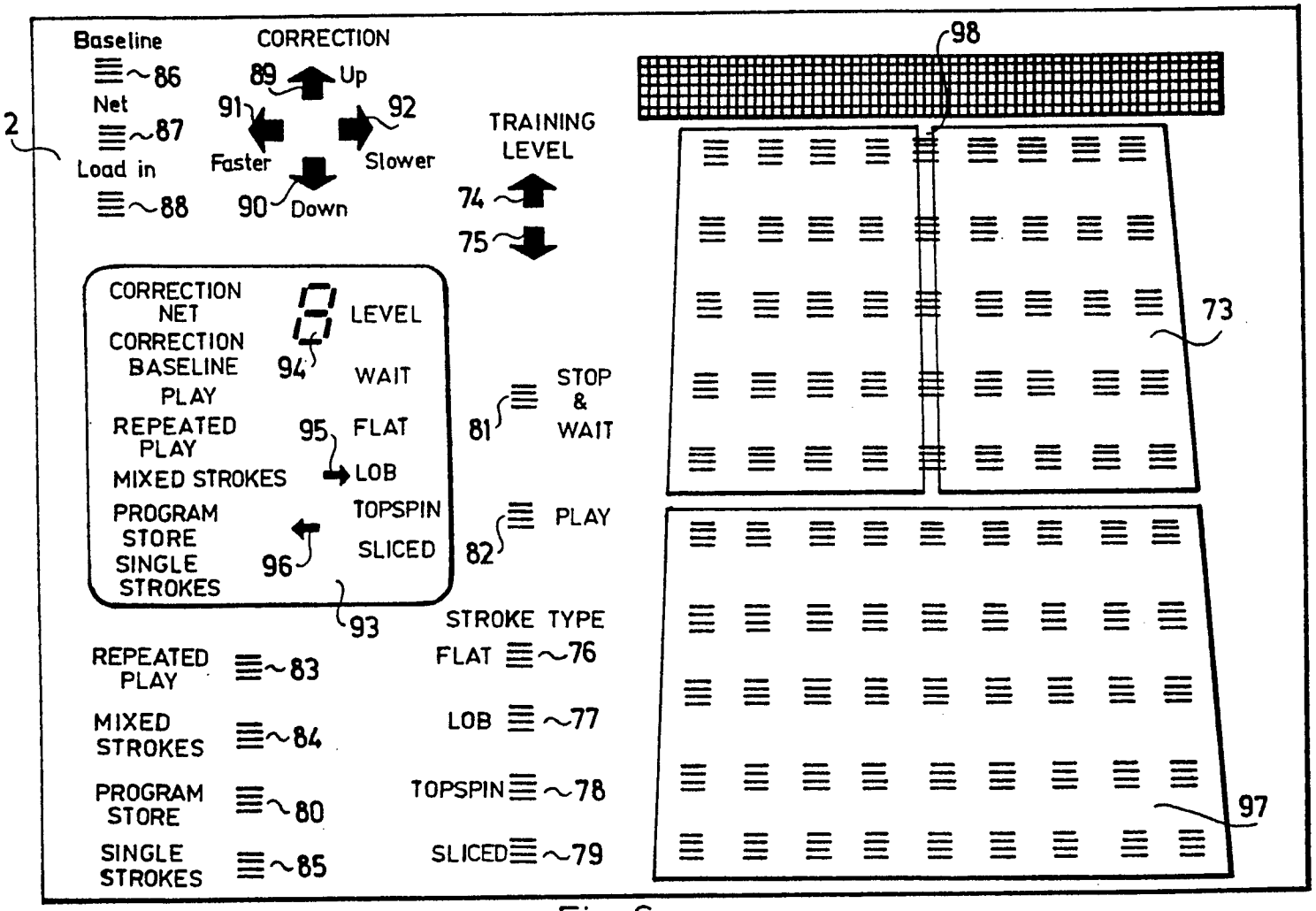
FIG. 6 shows still another detail: the keyboard of the remote control unit.

In FIG. 6, the layout of the membrane keyboard of remote control unit 2 holding key matrix 65 is shown. One part of the keys are formed in a submatrix 73 consisting of 10×9 keys, in order to simulate a tennis half-court. The size of submatrix 73 is limited from one side by the wanted topological resolution on the court and from another side, by the achievable accuracy of the strokes.

A second part of the keys serves for selecting the training level and the stroke type, and for entering the commands as operation modes, stop/wait, play and correction command.

With keys 74 and 75, ten different training levels can be set, which determine the ball speed and the repetition rate. The level 0 should be used by beginner, while the level 9 serves for professionals. Increasing or decreasing the level can be fulfilled by pressing keys 74 or 75 according to the sense of the depicted arrows. The actual level will be continuously displayed by LCD 93 in a decimal number 94.

The stroke type can be set to flat by key 76, to high trajectory lob by key 77, topspin by key 78 and to sliced ball by key 79.

A key 80 serves for the selection of the program store mode, wherein the stroke parameters including the impact point, the training level and the stroke type will be loaded for every stroke one by one into the program memory. The operation mode of store is showed on LCD 93 by an arrow 96. The store process can be stopped by pressing a key 81, thereafter the machine returns to wait mode indicated on LCD 93 by arrow 96.

The stored program can be started by pressing a key 82. After finishing the stroke sequence, the machine returns automatically to the wait mode. Immediate stop can be forced out by pressing key 81.

When a key 84 is pressed, the strokes of the stored program will be executed in a mixed manner, to eliminate the possibility of learning the strokes sequence by the player after a given number of repeats.

Pressing key 85, single strokes can be sent to the player in order to have sufficient time for the coach to give instructions.

Remote control unit 2 allows to compensate the wear-out of the balls. The consequence of the ball wear-out is that the balls exceed the baseline, highly disturbing hereby the player. Regarding the method of the parameter calculation based on the strokes directed to the check points 97 and 98, these parameters can be modified if necessary during the correction process. After pressing a key 86, only strokes directed to a check point 97 will be thrown out, while pressing any other key of impact points on the half-court will be taken as invalid, indicated by a warning signal. However, sending a ball to check point 97, the difference between the expected and the real impact points can be observed and thereafter, the direction of the needed modification can be made by cursor-like correction keys 89 to 92.

When keys 89 and 90 are presented, the vertical launching angle of the ball can be adjusted stepwise up or down. On the similar way, pressing keys 91 or 92, the speed of the ball can be adjusted stepwise to faster or slower. After adjusting the launching angle and the ball speed to the proper value by cursor-like keys 89 to 92, the corrected parameters can be reloaded in the non-volatile look-up table by pressing key 88.

The same correction process can be used with balls directed to a check point 98 at the net by pressing key 87.

As a matter of course, a lot of completion can be applied for making the machine in this invention more user friendly, sound or light signals, magnet card or bar code type data entering to make the programming of long stroke sequencies easier, a wireless remote control by using radiowaves or ultrasound, eliminating hereby the troublesome cable connection on the court, and finally, the usage of voice synthesis to inform the player about programming tasks.

For a more sophistocated game simulation, output channel 61 of microcomputer 40 can be used to link more ball throwing machines to each other, placing two of them in the corners and a third one in the center of the opposite half-court. In this case, a common program can be executed launching the balls alternately from the machines.

Beyond the application for tennis play, the throwing machine in this invention can be used for other sport games, like table tennis, baseball or even football, and, in addition, for some other electronic games, too.

We claim:

1. A ball throwing machine for ejecting tennis balls of the type comprising:

an adjustable rotating-wheel type ball throwing mechanism having a launch point for launching tennis balls at a predetermined angle and speed;

a microcomputer controlling the throwing mechanism and having memory means for storing launch angle and speed data; and a remote control unit attached to said microcomputer having a keyboard, wherein said ball throwing machine further comprises adjustment means for moving said rotating-wheel type ball throwing mechanism about said launch point to adjust horizontal and vertical attitude;

said microcomputer being programmed with standard target coordinates based on a standard machine placement to be used to calculate actual target coordinates based upon two check points empirically determined for each placement of said machine removed from said standard machine placement, said microcomputer also being programmed such that for balls impacting on a center line of a tennis court, the throwing mechanism is controlled to operate with a vertical angle and a launching speed being a function of a training level and a stroke type preselected on said keyboard, wherein a first of said two check points is a meshing point of a net and the center line of the tennis court, and the second check point is a meshing point of a baseline and center line; and said microcomputer further being programmed such that for balls impacting elsewhere, a horizontal angle of throwing out the balls is determined by a simple trigonometric relation allowing direct assignment of impact points from said remote control when said machine is removed from said standard machine placement; wherein a strain gauge is provided in said throwing mechanism to measure physical parameters of a ball and is connected to said microcomputer for correcting the angle and speed data of the impact points in dependence on ball qualities measured by said strain gauge.

2. The apparatus as claimed in claim 1, wherein said keyboard is a touch pad keyboard, and said memory means includes non-volatile storage means is provided for storing the corrected angle and speed data of the check points in the form of a look-up table.

3. The apparatus as claimed in claim 2, wherein said look-up table includes angle and speed data for ten different training levels and four different stroke types for the check points.

4. The apparatus as claimed in claim 1, wherein said remote control unit is attached to said microcomputer by a wireless connection.

5. A ball throwing machine capable of multiple skill level training comprising:

a) a stirred ball container;

b) said stirred ball container communicating with a barrel feed tube;

c) a piston feed means within said barrel feed tube;

d) two independent co-planar ejecting wheels positioned to receive individual balls fed from said barrel feed tube, a stationary launch point being defined by and between said two co-planar ejecting wheels;

e) an individually controlled rotation means associated with each of said independent co-planar ejecting wheels;

f) a gimbal-type framework allowing movement of said co-planar ejecting wheels and said barrel feed tube about two axes passing through said launch point;

g) two adjustment means, individually controllable, to move said co-planar ejecting wheels and said barrel feed tube about one axis, with respect to said launch point;

h) program control means comprising a microcomputer controlling said piston feed means, said individually controlled rotation means and said two adjustment means, said microcomputer means being programmed to be preset for various speeds of said rotation means and various orientations of said ejecting wheels and barrel feed tube about said launch point;

i) remote controlling means for said microcomputer, said microcomputer being responsive to said remote controlling means and responding by achieving preset conditions and allowing adjustment of said preset conditions, whereby the speed, direction and spin of a thrown ball can be remotely controlled and the impact point chosen and specifically adjusted for, thus allowing for varying conditions and differing placements of said ball throwing machine wherein said remote controlling means comprises a touch pad keyboard whereby a launch angle and a launch speed can be adjusted to provide accurate impact points of a ball at specific check points, said program control means comprising a non-volatile type memory in look-up table form for storing corrected angle and speed data for said check points and said program control means computes calibrated angle and speed data for other chosen impact points, based upon said corrected data for said check points and uses said calibrated angle and speed data for throwing balls as directed; and j) a strain gauge is provided to measure physical parameters of a ball, in said throwing mechanism and is connected to said microcomputer for correcting the angle and speed data of the impact points in dependence on ball qualities measured by said strain gauge.

6. A ball throwing machine as claimed in claim 5, further comprising a ball-catching grip in said barrel feed tube and a strain gauge on said grip, said strain gauge measuring physical parameters of a ball to be launched and connected to said microcomputer whereby said microcomputer can make angle and speed adjustments based upon said physical parameters measured.

7. A ball throwing machine as claimed in claim 5, further comprising:

k) a second stirred ball container;

l) said second stirred ball container communicating with a second barrel feed tube;

m) a second piston feed means within said second barrel feed tube;

n) two further independent co-planar ejecting wheels positioned to receive individual balls fed from said second barrel feed tube, a second stationery launch point being defined by and between said two further co-planar ejecting wheels;

o) further individually controlled rotation means associated with each of said independent co-planar ejecting wheels;

p) a second gimbal-type framework allowing movement of said further co-planar ejecting wheels and said second barrel feed tube about two axes passing through said second launch point; and q) two further adjustment means, individually controllable, each of said further means being capable of moving said further co-planar ejecting wheels and said second barrel feed tube about one axis, with respect to said launch point, wherein said components k through q form a separate ball throwing apparatus controlled by said program control means to allow consecutively thrown balls to come from different places in a play area, more closely approximating an opposing player.

8. A ball throwing machine for ejecting tennis balls of the type comprising:

an adjustable rotating-wheel type ball throwing mechanism having a launch point for launching tennis balls at a predetermined angle and speed;

a microcomputer controlling the throwing mechanism and having memory means for storing launch angle and speed data; and a remote control unit attached to said microcomputer having a data input device wherein said ball throwing machine further comprises adjustment means for moving said rotating-wheel type ball throwing mechanism about said launch point to adjust horizontal and vertical attitude;

said microcomputer being programmed with desired target coordinates to control said ball launch angle and speed to provide a number of preselectable target points positioned in relation to a check point; and a strain gauge provided in said throwing mechanism to measure physical parameters of a ball and connected to said microcomputer for correcting the angle and speed data of the impact points in dependence on ball qualities measured by said strain gauge.

* * * * *